US005708234A

United States Patent [19]

Frontierro

[11] Patent Number: 5,708,234

[45] Date of Patent: Jan. 13, 1998

[54] WIRE CONNECTOR

[76] Inventor: Joseph Frontierro, 1970 N. Hartford St., Unit 60, Chandler, Ariz. 85224

[21] Appl. No.: 607,786

[22] Filed: Feb. 27, 1996

Related U.S. Application Data

[63] Continuation-in-part of Ser. No. 299,957, Sep. 2, 1994, abandoned.

[51] Int. Cl.[6] ..... H01R 13/33

[52] U.S. Cl. ..... 174/87; 439/840

[58] Field of Search ..... 174/84 R, 87; 403/214, 268, 270; 439/840

[56] References Cited

U.S. PATENT DOCUMENTS

| | | | |
|---|---|---|---|
| 2,965,700 | 12/1960 | Kusiv | 174/87 |
| 4,504,699 | 3/1985 | Dones et al. | 174/84 R |
| 5,531,618 | 7/1996 | Market | 439/840 |

FOREIGN PATENT DOCUMENTS

| | | | |
|---|---|---|---|
| 974616 | 2/1951 | France | 174/87 |
| 1077700 | 8/1967 | United Kingdom | 174/84 R |

*Primary Examiner*—Kristine L. Kincaid
*Assistant Examiner*—Chau N. Nguyen
*Attorney, Agent, or Firm*—David L. Volk

[57] ABSTRACT

An insulating outer shell includes structure forming a first opening in a first end of the outer shell, and structure forming a second opening in a second end of the outer shell. A conductive inner shell having a closed end and an open end is fitted inside the outer shell such that the closed end is oriented toward the first end of the outer shell and the open end is oriented toward the second end of the outer shell. A first conductor extends through the first opening of the outer shell. One end of the first conductor is welded to the closed end of the inner shell. The first conductor has a free end. A spring for engaging at least one second conductor within the inner shell is welded to the inside of the inner shell.

2 Claims, 2 Drawing Sheets

WIRE CONNECTOR

CROSS REFERENCE TO RELATED APPLICATIONS

This is a continuation-in-part of Ser. No. 08/299,957, filed Sep. 2, 1994, now abandoned.

BACKGROUND

1. Field of the Invention

This invention relates to wire connectors, specifically to a wire connector suitable for connecting aluminum wire to copper wire.

2. Description of Prior Art

When copper electrical wire is in contact with aluminum electrical wire, the aluminum wire corrodes due to galvanic action of dissimilar metals. This means that the well known twist-on type wire connector used by electricians is unacceptable for connecting aluminum electrical wire to copper wire, without some kind of modification to inhibit the galvanic action.

A twist-on type wire connector which is currently on the market uses an inhibitor grease within the wire connector to inhibit the galvanic action of the copper to wire connection. The galvanic action will be inhibited using this type of connector, but not entirely eliminated. The grease is messy, particularly in warmer climates which will tend to make the grease thinner and runnier.

Another method for connecting aluminum and copper wires is to use a crimp-type connector. The galvanic action is not entirely eliminated by this type of connector, because there is direct contact between copper and aluminum. A tool must be used to crimp the wires together within the connector. Compared to the twist-on type connector which requires no tools, the crimp-type connector is more cumbersome and more difficult to use in tight spaces.

There exists a need for a twist-on type wire connector which uses no messy inhibitor grease and results in no direct connection between the copper and aluminum wires, thereby eliminating the galvanic action of dissimilar metals.

SUMMARY

The wire connector of the present invention includes an insulating outer shell having structure forming a first opening in a first end of the outer shell, and structure forming a second opening in a second end of the outer shell.

A conductive inner shell having a closed end and an open end is fitted inside the outer shell such that the closed end is oriented toward the first end of the outer shell and the open end is oriented toward the second end of the outer shell.

A first conductor extends through the first opening of the outer shell. One end of the first conductor is welded to the closed end of the inner shell. The first conductor has a free end.

A spring for engaging at least one second conductor within said inner shell is welded to the inside of said inner shell.

The inner shell is fabricated of steel. The first conductor is copper.

The wire connector can be used to connect aluminum conductors to copper conductors by engaging at least one aluminum conductor within the conductive inner shell, and connecting the free end of the copper conductor to another copper wire. Electricity is conducted from the aluminum conductor, through the conductive inner shell to the copper conductor. Because there is no direct copper to aluminum connection, galvanic action from contact between dissimilar metals is eliminated.

DETAILED DESCRIPTION

Figure 1:
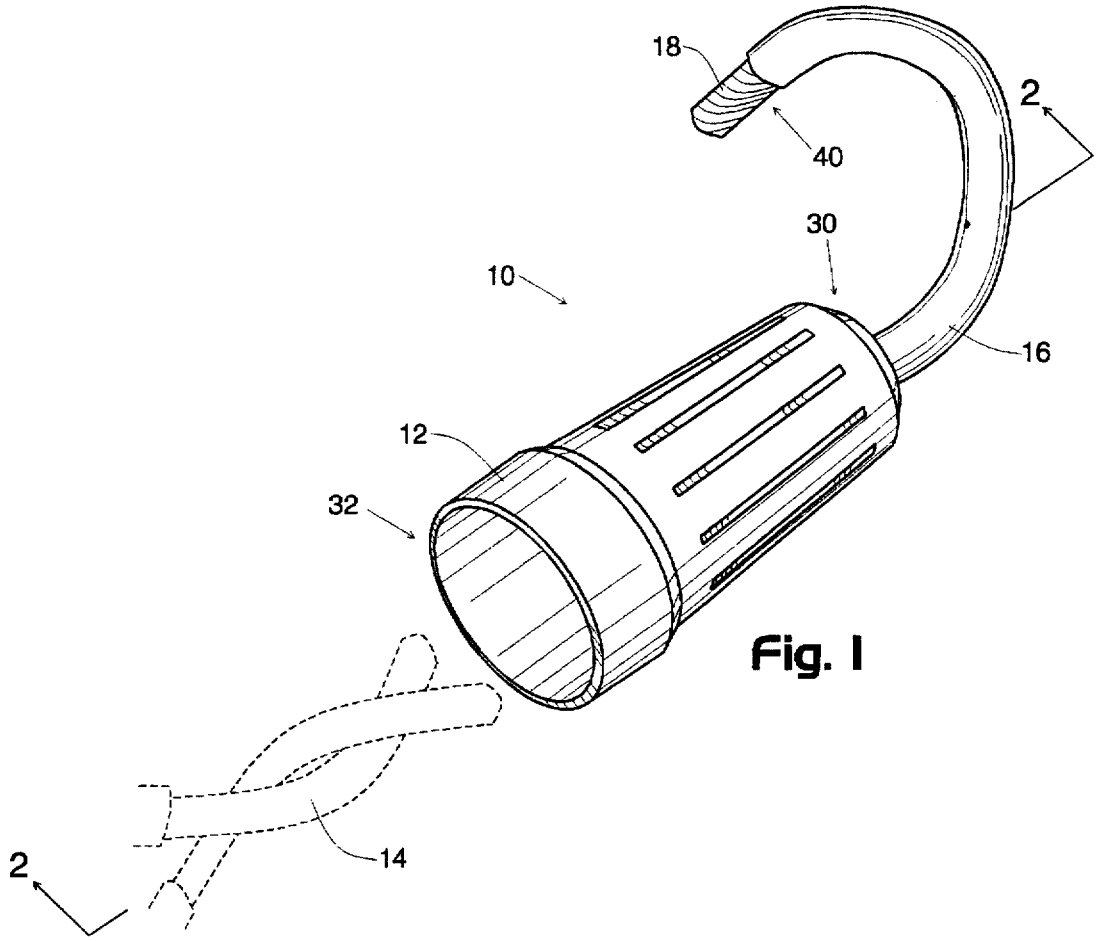
FIG. 1 is a perspective view of the wire connector.

FIG. 1 shows a wire connector 10, having an insulating outer shell 12. The outer shell 12 may be of molded plastic. The outer shell includes a first end 30 and a second end 32.

Figure 2:
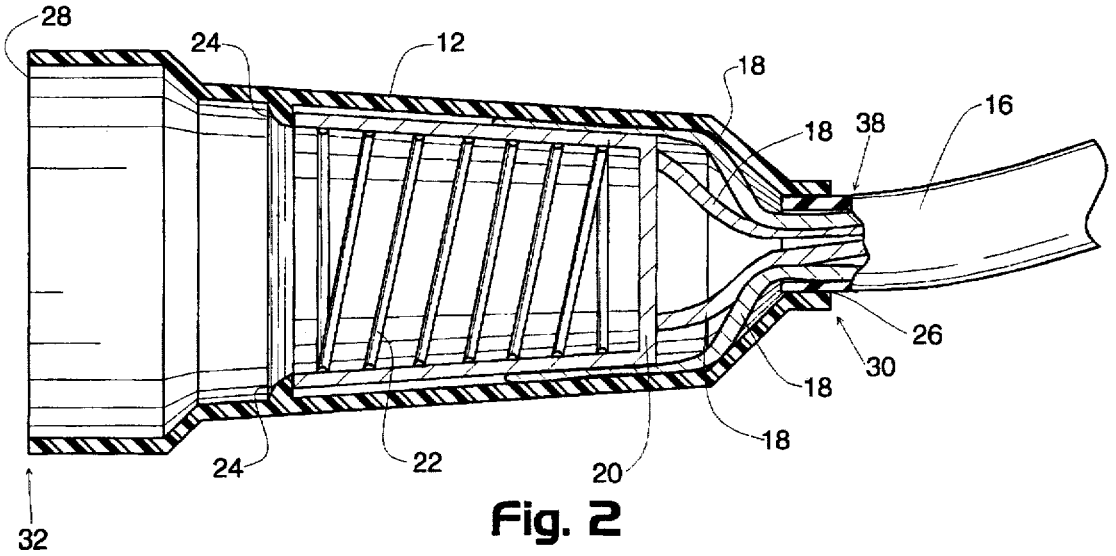
FIG. 2 is a cross-sectional view of the wire connector, taken along line 2—2 of FIG. 1.

FIG. 2 is a cross-sectional view of the wire connector 10, taken along line 2—2 of FIG. 1. Referring to FIGS. 1 and 2, the outer shell 12 has structure forming a first opening 26 in the first end 30 of the outer shell 12, and structure forming a second opening 28 in the second end 32 of the outer shell 12. A steel inner shell 20 is fitted inside the outer shell 12. The inner shell 20 is held within the outer shell 12 by a ring shaped lip 24 formed on the interior of the outer shell 12.

Figure 3:
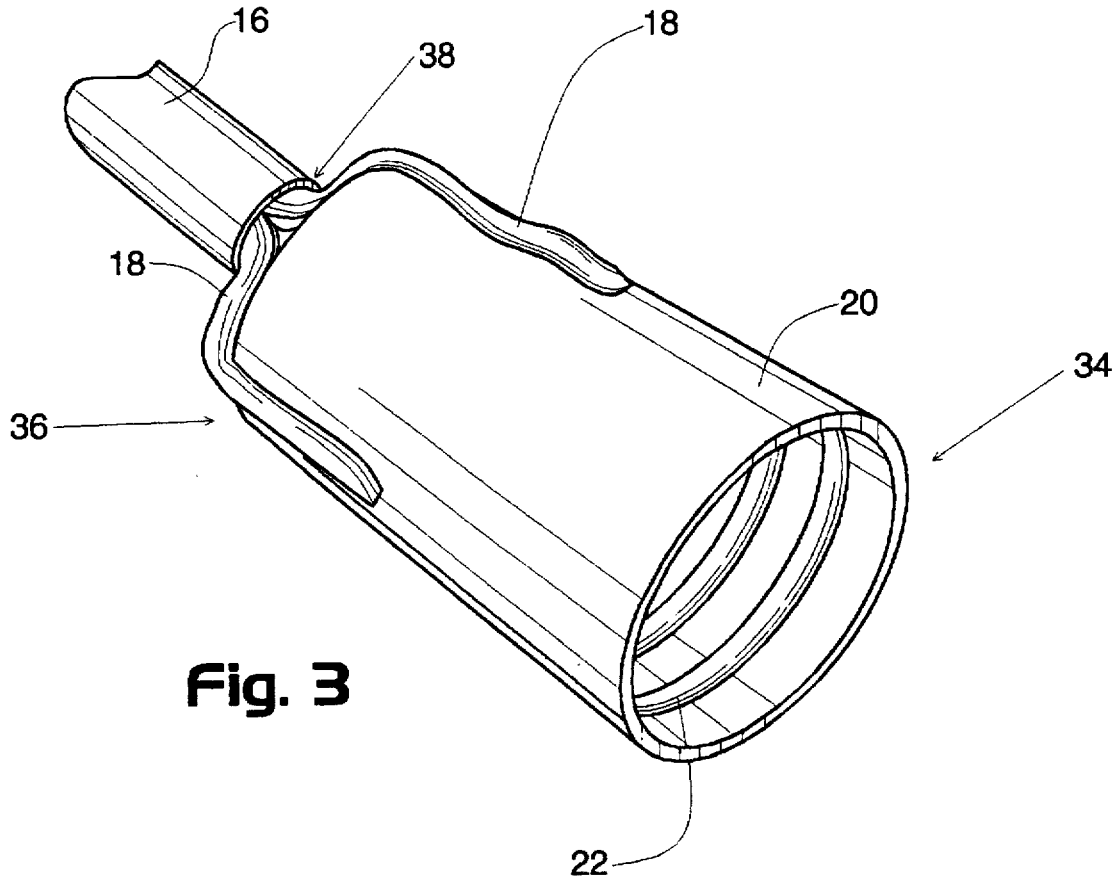
FIG. 3 is a perspective view of the inner shell and copper conductor of the wire connector.

FIG. 3 is a perspective view of the inner shell 20, shown without the outer shell 12 for clarity. The inner shell 20 has a closed end 36 and an open end 34. Referring to FIGS. 1, 2 and 3, a first conductor 16 extends through the first opening 26 of the outer shell 12. The first conductor 16 comprises a plurality of stranded copper wires 18. One end 38 of the first conductor 16 has the wires 18 separated from one another. The wires 18 are welded in surrounding relationship to the closed end 36 of the inner shell 20. The first conductor 16 has a free end 40 to which another conductor (not shown) may be connected.

A spring 22 is welded to the inside of the inner shell 20. Referring to FIGS. 1, 2 and 3, at least one second conductor 14 may be twistingly inserted into the inner shell 20, the second conductor 14 being engaged by the spring 22.

The inner surface of the inner shell 20 may include grooves (not shown) for engaging the second conductor 14, in which case the spring 22 would not be required.

CONCLUSION, RAMIFICATIONS AND SCOPE

Thus the wire connector of the present invention connects to copper conductors to aluminum conductors without direct contact between the dissimilar metals. This is accomplished without greasy mess or crimping tools.

While the above description contains many specificities, these should not be construed as limitations on the scope of the invention, but rather as an exemplification of one preferred embodiment thereof. Many variations are possible.

Accordingly, the scope of the invention should be determined not by the embodiment illustrated, but by the appended claims and their legal equivalents.

The invention claimed is:

1. A wire connector for connecting at least one aluminum wire conductor to a copper wire conductor, the wire connector comprising:

a. an insulating outer shell, said outer shell having a first end and a second end;

b. said outer shell having structure forming a first opening at said first end, and structure forming a second opening at said second end;

c. an inner shell having a closed end and an open end;

d. said inner shell constructed of a material selected from the group consisting of steel and steel alloy;

e. said inner shell fitted inside said outer shell such that said closed end is oriented toward said first end of said outer shell and said open end is oriented toward said second end of said outer shell;

f. a copper first conductor extending through said first opening of said outer shell, one end of said first conductor welded to said closed end of said inner shell, said first conductor having a free end for connection to the copper wire conductor; and g. said inner shell having an engaging means for engaging the at least one aluminum wire conductor within said inner shell.

2. The wire connector of claim 1, wherein said engaging means comprises a spring welded to the inside of said inner shell.

* * * * *